US008672215B2

(12) United States Patent
Learn

(10) Patent No.: US 8,672,215 B2
(45) Date of Patent: Mar. 18, 2014

(54) FLEXIBLE HINGE CLAM SHELL FOOD SERVICE CONTAINER WITH CONTINUOUS SIDEWALL CONSTRUCTION

(75) Inventor: Angela E. Learn, Gilbertsville, PA (US)

(73) Assignee: Pactiv Packaging Inc., Lake Forest, IL (US)

( * ) Notice: Subject to any disclaimer, the term of this patent is extended or adjusted under 35 U.S.C. 154(b) by 461 days.

(21) Appl. No.: 12/929,768

(22) Filed: Feb. 15, 2011

(65) Prior Publication Data

US 2012/0000972 A1 Jan. 5, 2012

Related U.S. Application Data

(60) Provisional application No. 61/344,351, filed on Jul. 2, 2010.

(51) Int. Cl.
*B65D 5/20* (2006.01)
*B65D 5/68* (2006.01)

(52) U.S. Cl.
USPC ..... 229/114; 229/115; 229/145; 229/146; 229/148; 229/906

(58) Field of Classification Search
USPC ..... 229/113, 114, 115, 145, 146, 148, 149, 229/154, 160.1, 902, 906, 920, 930, 931
See application file for complete search history.

(56) References Cited

U.S. PATENT DOCUMENTS

| | | | | | |
|---|---|---|---|---|---|
| 2,316,701 | A * | 4/1943 | Marshall | 229/117.04 |
| 2,623,684 | A * | 12/1952 | Collura | 229/117.07 |
| 3,019,957 | A * | 2/1962 | Palmer | 229/122 |
| 3,623,650 | A * | 11/1971 | Watts | 206/509 |
| 4,331,238 | A * | 5/1982 | Hanko et al. | 206/518 |
| 4,760,950 | A | 8/1988 | Levick | |
| 4,765,534 | A * | 8/1988 | Zion et al. | 229/109 |
| 5,098,013 | A * | 3/1992 | France et al. | 229/115 |
| 5,205,476 | A | 4/1993 | Sorenson | |
| 5,577,989 | A | 11/1996 | Neary | |
| 5,788,145 | A * | 8/1998 | Grahahm et al. | 229/113 |
| 6,223,979 | B1 * | 5/2001 | Correll | 229/114 |
| 6,364,203 | B2 | 4/2002 | Toussant et al. | |
| 7,021,526 | B2 | 4/2006 | Nishikawa et al. | |
| D519,830 | S | 5/2006 | Yokum | |
| 7,128,257 | B2 * | 10/2006 | Hyatt et al. | 229/183 |
| 7,631,800 | B2 * | 12/2009 | Cai et al. | 229/120.18 |
| 7,661,580 | B1 * | 2/2010 | Bazan | 229/149 |
| 2007/0012754 | A1 * | 1/2007 | Stier | 229/108 |

* cited by examiner

*Primary Examiner* — Gary Elkins
(74) *Attorney, Agent, or Firm* — Baker Botts L.L.P.

(57) ABSTRACT

There is described herein a disposable clam shell food service container having a continuous sidewall which includes a novel flex-hinge panel between the lid and bottom of the container. This construction permits the container to open easily when the lid is pushed upwardly resulting in a flat tray like configuration devoid of the typical upstanding median wall or divider and which may be used as a serving plate by the consumer. The container may be easily snapped closed and locked to allow later consumption of any uneaten food products. Several additional embodiments of the invention are also presented, all of which include a continuous sidewall which ensures that the food product will remain warm and one of several lock means to secure the container in its closed condition. A triangular form of the container is also described for serving of pizza, pies and similar shaped food products.

21 Claims, 16 Drawing Sheets

FLEXIBLE HINGE CLAM SHELL FOOD SERVICE CONTAINER WITH CONTINUOUS SIDEWALL CONSTRUCTION

CLAIM OF PRIORITY UNDER 35 U.S.C. §119(e)

Applicant claims the benefit of priority of her Provisional Patent Application No. 61/344,351, which was filed on Jul. 2, 2010.

FIELD OF THE INVENTION

The present invention relates to new and improved disposable food service containers primarily for use by fast-food service establishments. The invention also encompasses new and novel blank forms for constructing and erecting my new containers.

BACKGROUND OF THE INVENTION

The new package or container presented herein is preferably manufactured from paperboard such as kraft, however, it can be constructed from other suitable materials such as plastics, as is common in the industry. Such containers are relatively inexpensive to manufacture and provide an easily erected package that is time-saving for the food service establishment as well providing a sturdy, attractive package for the consumer which serves to maintain the temperature of the food product packaged therein and prevents spilling due to the sidewall construction.

Containers or packages of the type described herein are particularly useful for the packaging and service of a wide variety of fast-food products such as, flat breads, wraps, burritos, tacos, chicken nuggets, pizza, pita sandwiches and the like. Partially erected packages are stored in the food service establishment in a nested manner ready to accept the particular food product being sold and are then closed by the server before being given to the customer.

Clam shell containers are well known in the art as exemplified by U.S. Pat. Nos. D519,830, 5,205,476, 5,577,989, 5,909,373, 6,439,875, and 7,021,526. Such containers are conventionally made from a single paperboard blank which is cut and scored to provide a plurality of hingedly connected panels. Clam shell containers normally include a lid or cover and an integral container base that are hinged together. The user can close the lid in order to keep the food product warm and a locking means is usually provided to temporarily secure the lid onto the base until such time as the customer wishes to open the same.

My new clam shell design and the several variations set forth herein result in cost savings due to the reduction in the amount of glue needed to initially form the container. Only a maximum of four adhesive points are employed as opposed to eight, as is conventional in the prior art. Further, less paperboard material waste is achieved and costs are saved as a result of less complex forming, reduced complexity of the tooling employed, less production spoilage and better alignment.

A principal object of my invention is to provide a food service clam shell container having sidewalls wherein after the food product is placed therein and the package closed for delivery, the purchaser may open the package and use it as a flat tray or dish while consuming the product and can thereafter close the package for later consumption of the remaining food product. The product is surrounded on all sides by the package sidewalls in order to avoid leakage and spillage. This new design serves to maintain the integrity of the container when it is used as a tray in the fully open position due to the stable sidewalls which extend all about the periphery.

An additional object of the invention is to provide an attractive and pleasing shape for a food service clam shell container on which graphic designs, trademarks and logos can be imprinted.

Yet another object of my invention is to provide a food service clam shell container that is inexpensive to produce, which can be stored in a nested manner and which is reliable and simple for the user to open and close. A flexible hinge construction serves to make the container virtually self erecting. A snap-over action created by the specific score placement in the blank from which the container is formed creates a flex-hinge back panel.

Further objects of the invention will become apparent upon a careful reading of the appended specification, claims and drawings, and wherein like reference characters refer to the same elements which appear in the several views.

SUMMARY OF THE INVENTION

A container for a food product for use by fast-food service establishments that is constructed according to the teachings of the present invention comprises a paperboard or like material foldable blank that is cut and scored to define a front panel which serves as the bottom of the container and a rear panel which serves as the top or lid for the container. The bottom or front panel is slightly longer in depth than the top or rear panel so that a flap formed on the bottom panel will overlie a similar flap on the top panel, permitting locking tabs on the top panel to snap into and engage recesses on the front panel. Side wall panels are provided hingedly connected to the sides of both the front and rear panels.

A wide variety of locking configurations as are well known in the art can be employed for securing the top and bottom of the containers and they play no part in the patentable novelty of this application.

A rear wall is provided in the blank which is intermediate and joins the rear panel and the front panel and is curved at least in part in some forms of this invention. This construction provides a flex-hinge action when the container is unlocked and the customer applies pressure to open the container.

BRIEF DESCRIPTION OF THE DRAWINGS

These and other objects of my invention will be appreciated and understood by those skilled in the art from the detailed description of the preferred embodiment of the invention and from the following drawings in which.

DETAILED DESCRIPTION OF A PREFERRED EMBODIMENT

Figures 1, 2:
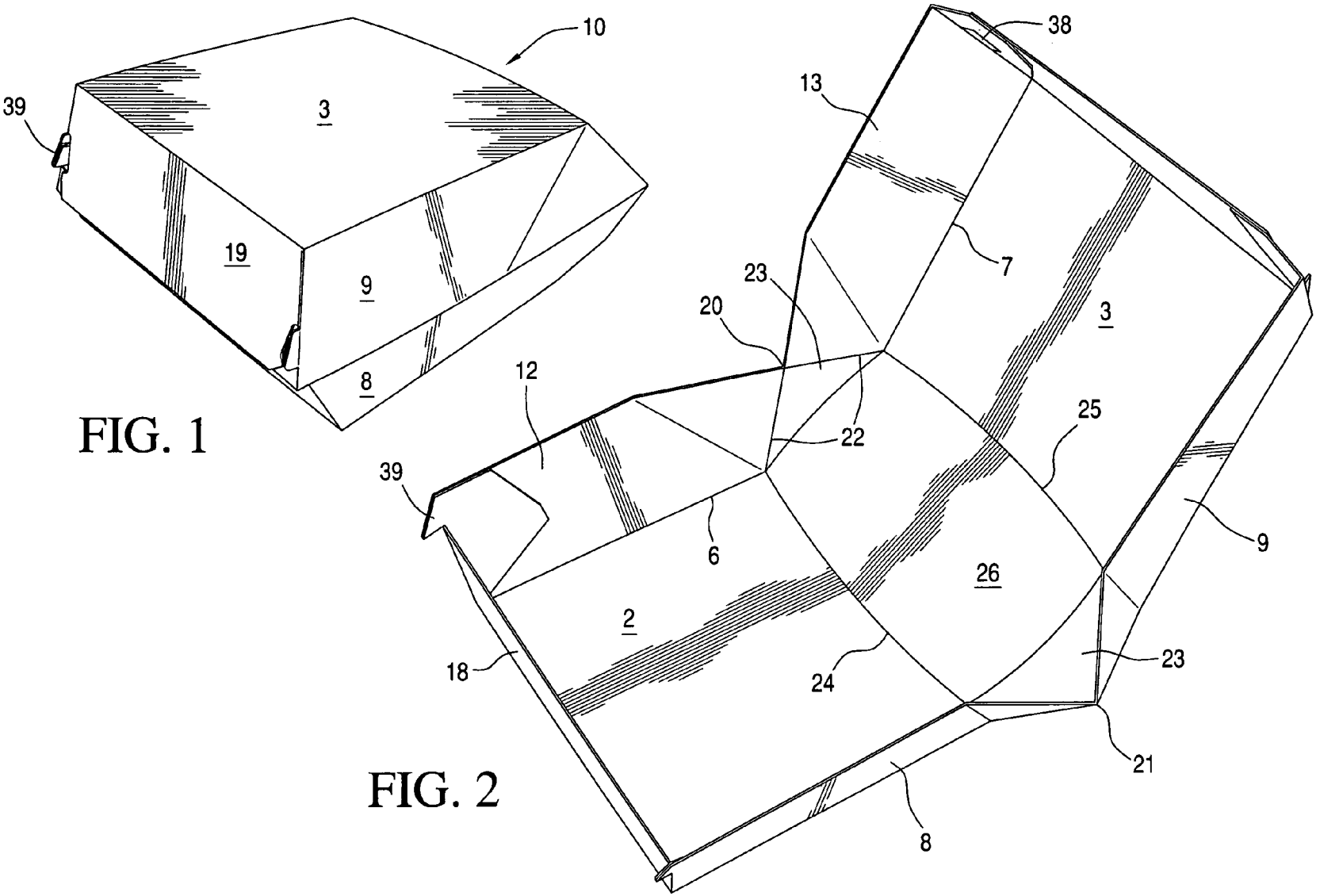
FIG. 1 is a top left front perspective view of a preferred embodiment of the invention.
FIG. 2 is a top perspective view of the container of FIG. 1 when it is in the open position.

With reference to the drawings the clam shell container of the preferred embodiment of my invention is shown at 10 in FIG. 1.

The blank used to form the container 10 is shown generally at 11 and uses only four glue points or tabs T to achieve the assembled configuration of FIG. 2.

Figure 3:
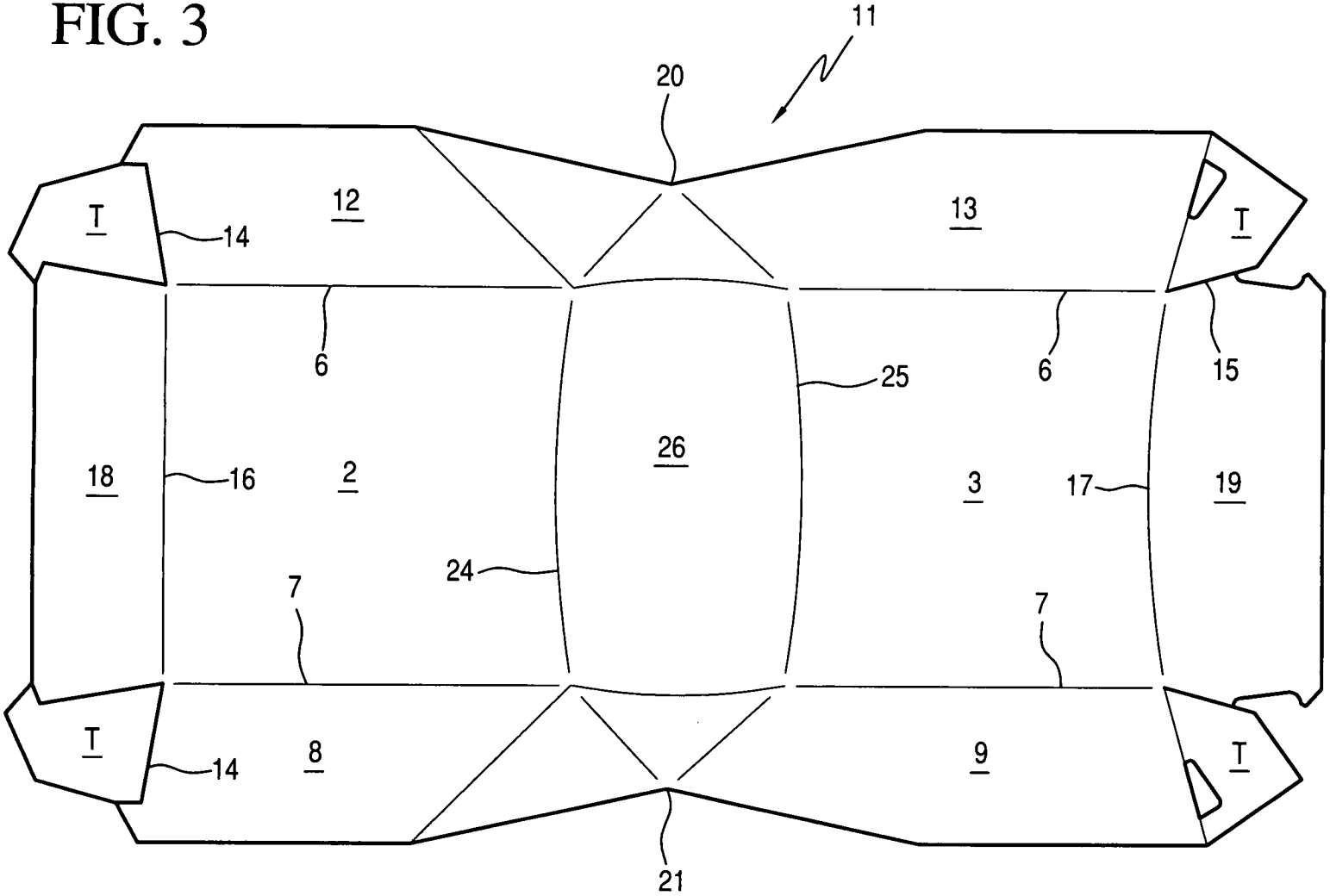
FIG. 3 is a top plan view of the blank used in forming the clam shell container of FIGS. 1 and 2.

The front panel 2 of the blank in FIG. 3, serves as the bottom of the container and is slightly longer or equal in depth than the rear panel 3 which becomes the top of the container when it is closed.

Opposed parallel vertical score lines 6 and 7 are formed in both the top and bottom portions of the blank 11 as shown in FIG. 3. These score lines permit the side sections or wings of the blank 8, 9, 12 and 13 to be folded inwardly to define the sidewalls of the container.

It will be noted that the sidewalls 9 and 13 are adapted to overlie the sidewalls 8 and 12 when the box is closed as seen in FIG. 1.

During the initial die-cutting of the blank, slits 14 are cut into the lower portion of the blank and slits 15 are formed in the upper portion of the blank to create the tabs T which serve as the four glue points in the container blank assembly.

A straight fold line 16 is formed in the front panel 2 generally transverse to the fold lines 6 and 7. A slightly inwardly curved fold line 17 is formed in the rear panel 3 of the blank. These fold lines form the lower and upper front faces 18 and 19 of the container, which due to the curved fold line 17 provides an attractive arched configuration of the closed container which will allow for the packaging of larger products such as double hamburgers or club sandwiches.

It will be noted that the height of the side sections 9 and 13 are higher than the side sections 8 and 12 and the sections meet to form a "V" as shown at 20 and 21. Score lines 22 extend at approximately a 45° angle from the joinder or "V" points where the score lines meet the vertical score lines 6 and 7. This creates a generally triangular area 23 on each side of the blank.

In the embodiments of FIG. 1 and others, a pair of spaced apart slightly curved score lines 24 and 25 extend across the blank from the vertical score lines 6 and 7 and terminate at the points where the score lines 22 meet the vertical score lines. The area between the lines 24 and 25 shown at 26 provides the rear wall of the erected container.

The container to be formed by the blank is erected by pulling outwardly on the sidewalls in the area immediately adjacent the triangular areas 23. This will result in the self-erection of the container. The triangular areas 23 will present a swept wing-like configuration as seen in FIG. 1. The angled score lines 22 guide the bottom side walls 8 and 12 inwardly, thereby allowing the top sidewalls 9 and 13 to overlie the bottom sidewalls resulting in a relatively tight seal for the closed container. Such construction retains heat in the inside of the clamshell and also prevents leakage.

In this form of my invention, the tabs T on the top or upper portion of the blank 3 are provided with a triangular opening 38. The tabs T on the lower or bottom panel 2 are formed with an extending finger 39. When the cover of the container is closed, the openings 38 will move over the fingers 39 which will snap into place serving to lock the container in a closed position.

The container will, when opened by the consumer, snap into a tray-like configuration or flat tray, absent the usual center divider wall that is common in the prior art. This will enable the product to be consumed as if it were on a plate or tray. In the event that the consumer wishes to retain some of the product for later consumption, the container can again be snapped into a closed configuration.

Figure 5:
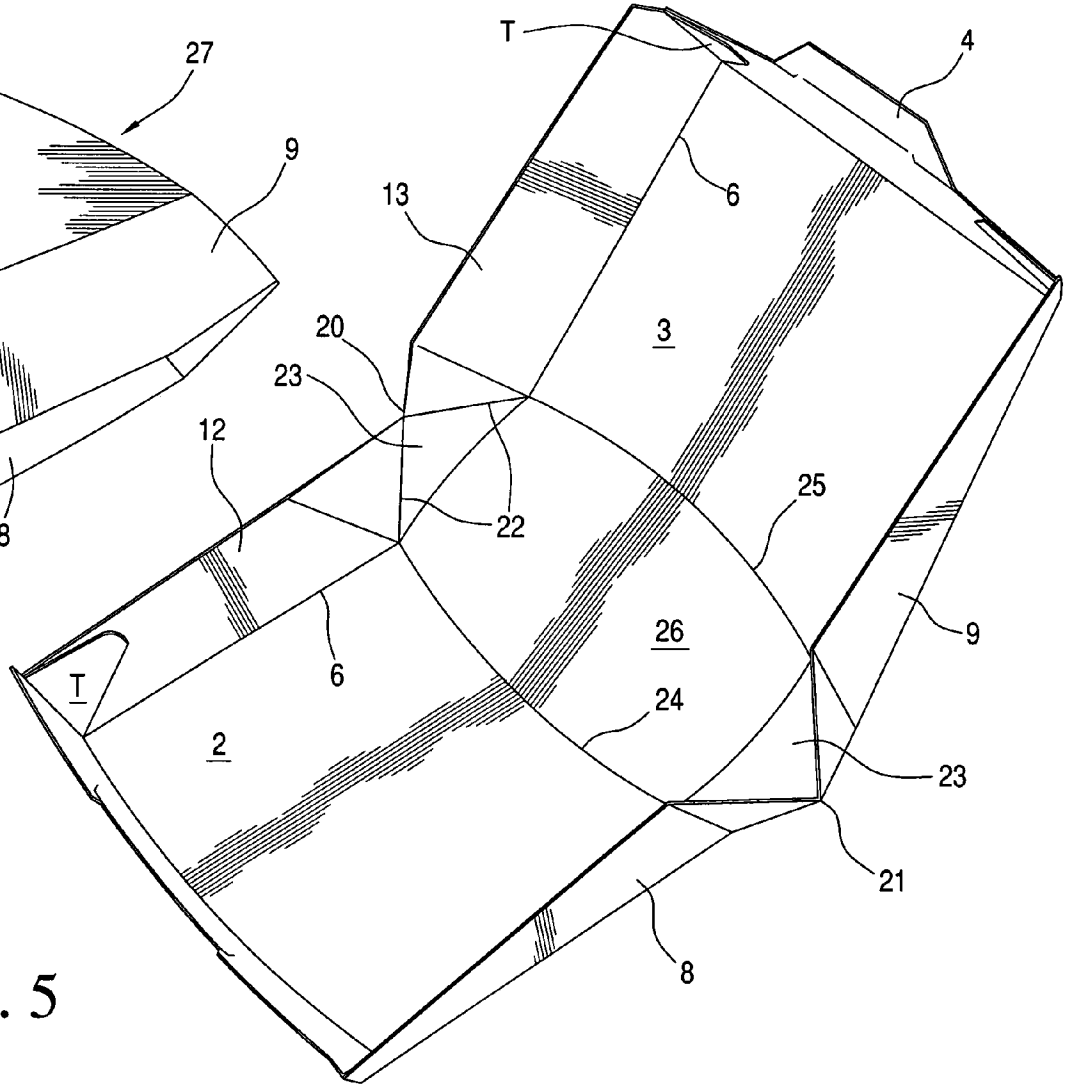
FIG. 5 is a top perspective view of the container of FIG. 4 when it is in the open position.
Figure 4:
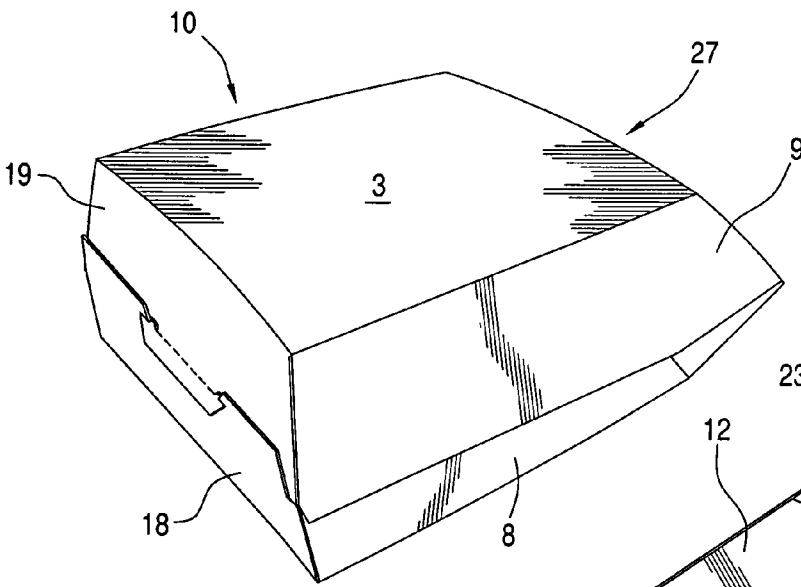
FIG. 4 is a top left front perspective view of a second form of my container.
Figure 6:
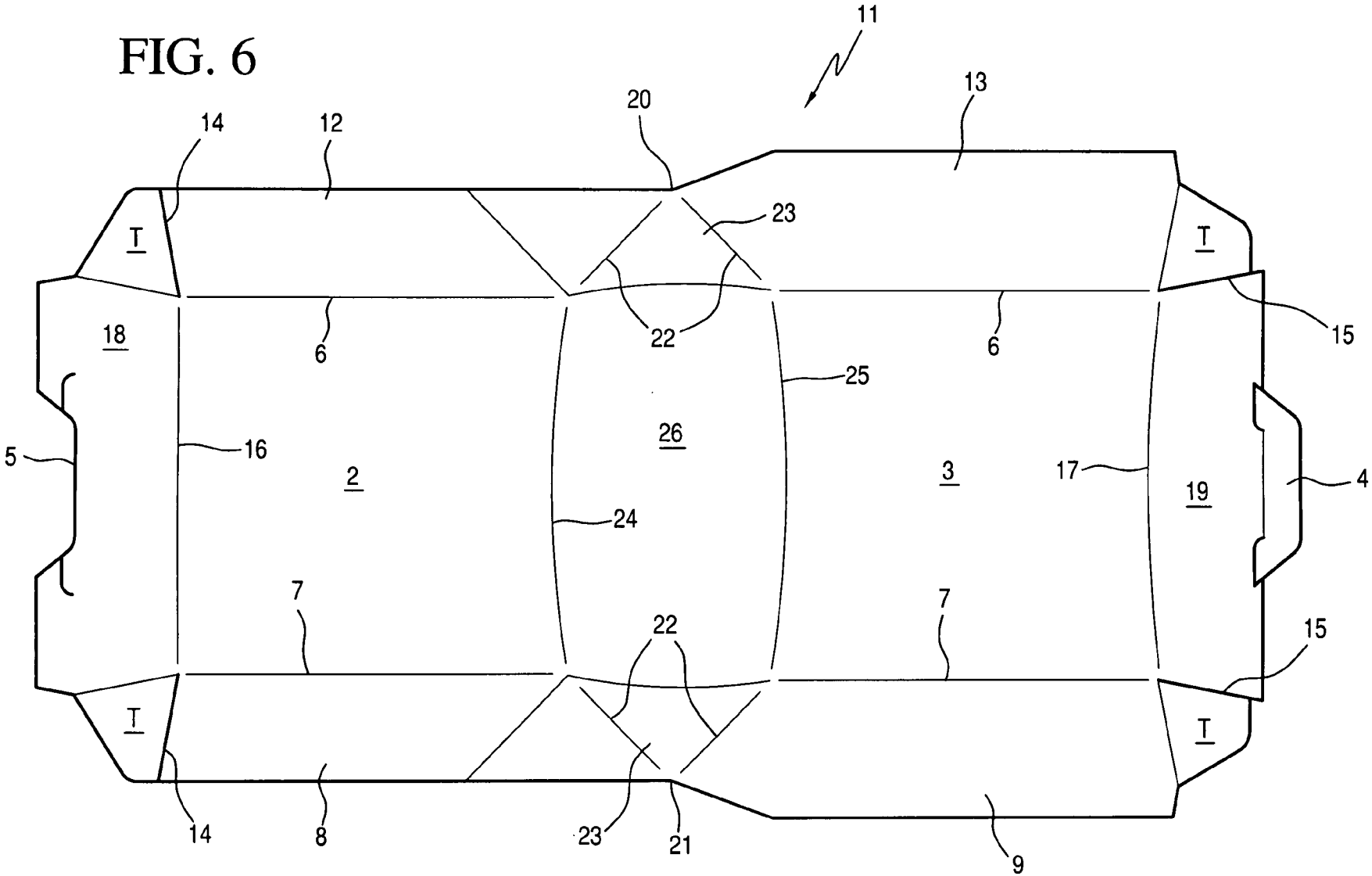
FIG. 6 is a top plan view of the blank used in forming the clam shell container of FIGS. 4 and 5.

The embodiment of the invention shown in FIGS. 4-6 is similar to the preferred embodiment of FIG. 1 in most respects. Here the assembled container is shown generally at 27. An extending flap 4, is formed on the leading edge of the rear panel 3. A cut-out 5 is formed on the leading edge of front panel 2 and serves with the flap 4 to lock the container in a manner well known in the art as can be seen in FIG. 4.

Erection of this embodiment is the same as the FIG. 1 embodiment; that is, outward pressure adjacent the triangular areas 23 will cause self-erection of the container.

Figures 7, 8:
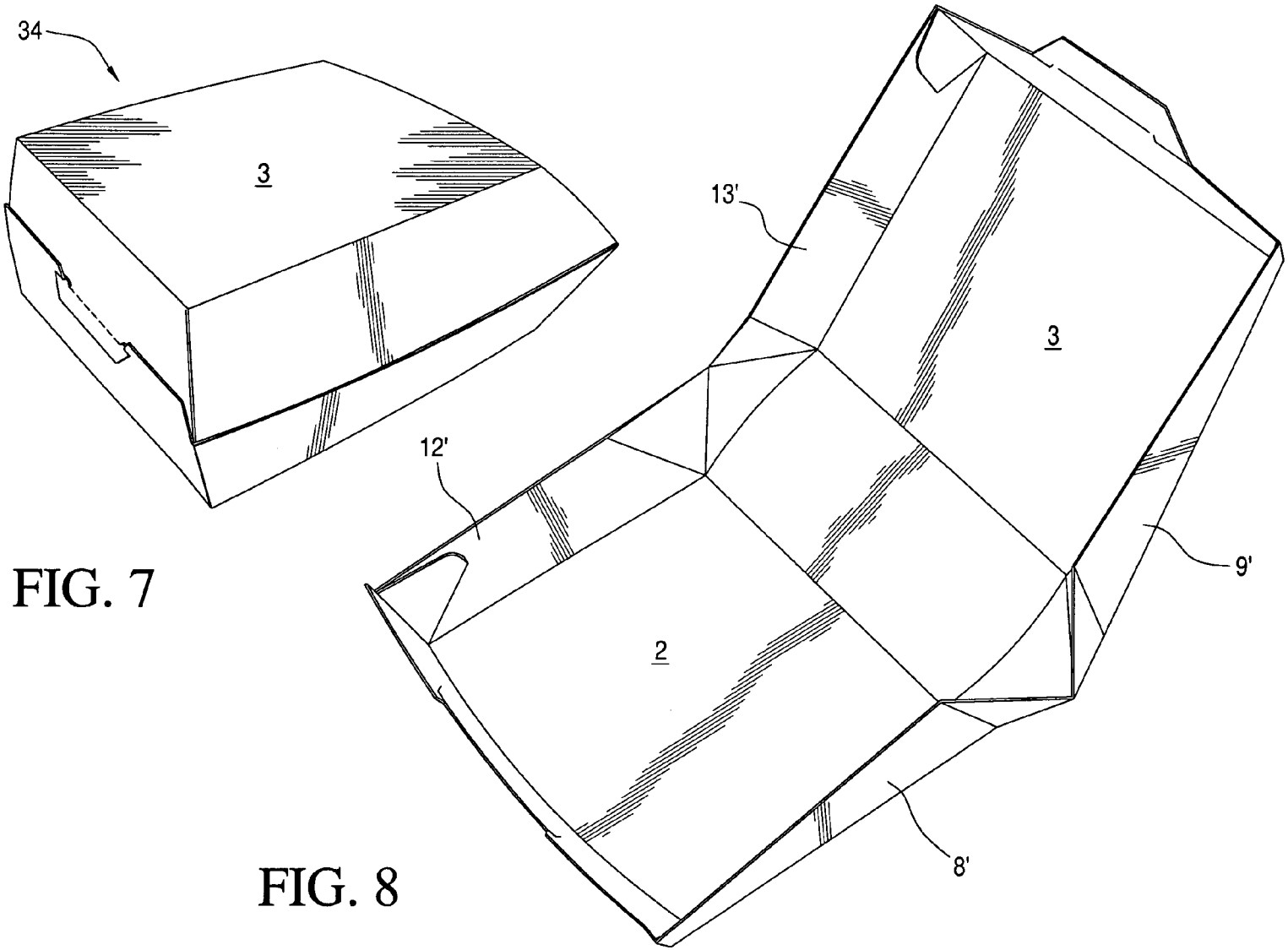
FIG. 7 is a top left front perspective view of yet another form of my container.
FIG. 8 is a top perspective view of the container of FIG. 7 when it is in the open position.
Figure 9:
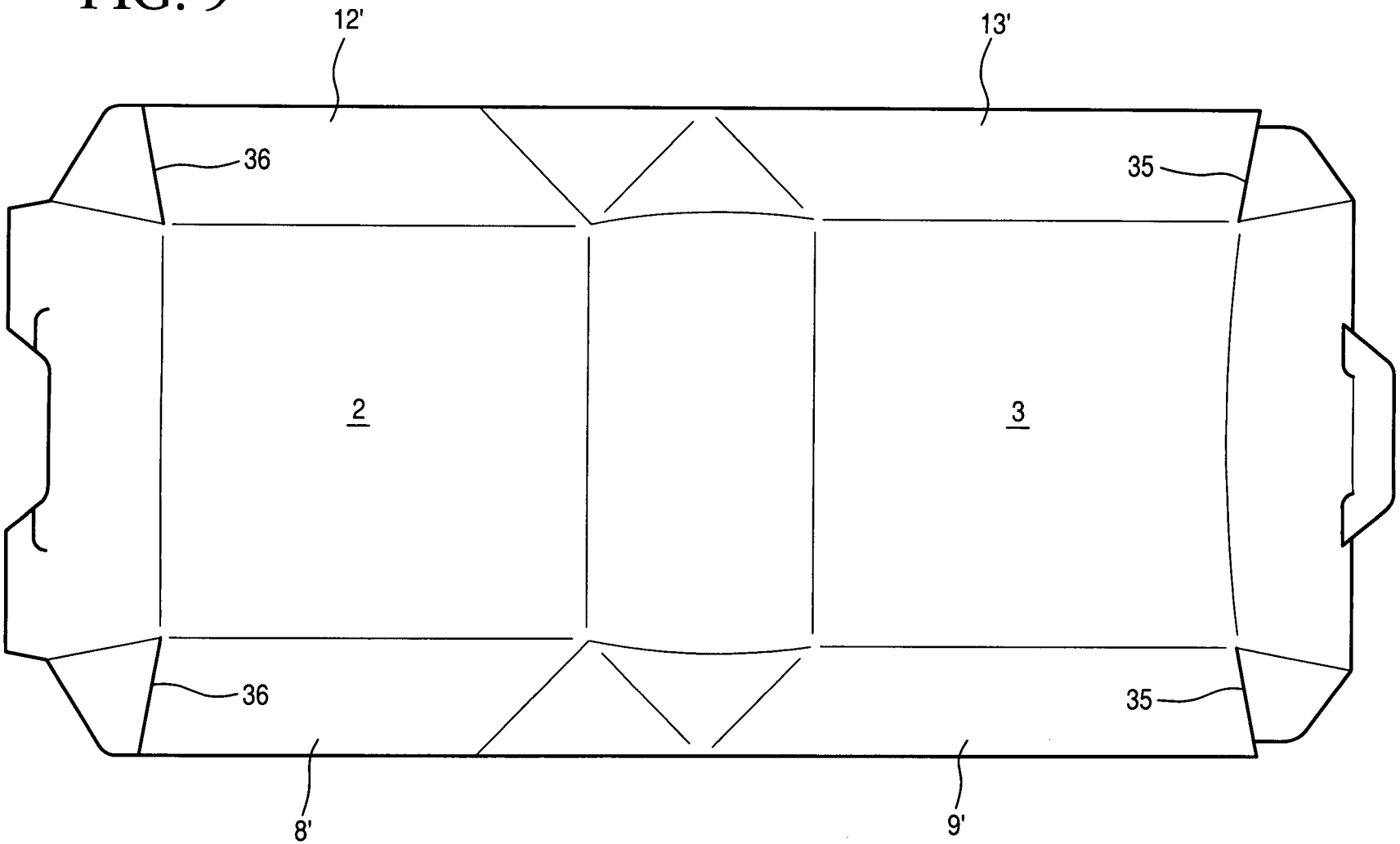
FIG. 9 is a top plan view of the blank used in forming the clam shell container of FIGS. 7 and 8.

The embodiment of my invention depicted in FIGS. 7-9 shown generally at 34 is an economy version of the embodiment of FIG. 4. In this form, the sidewalls are straight and the height of the side panels 8', 9', 12', and 13' are all the same. In this economy version of the container, there is no overlapping of the side panels as in the previously described embodiments.

The angle of the tab cuts 35 on the top or rear panel 3 are approximately 10°, whereas the tab cuts 36 on the bottom panel 2 are at a greater angle, approximately 15°, thereby preventing the top or lid from collapsing into the lower tray portion when closing the container.

Figure 11:
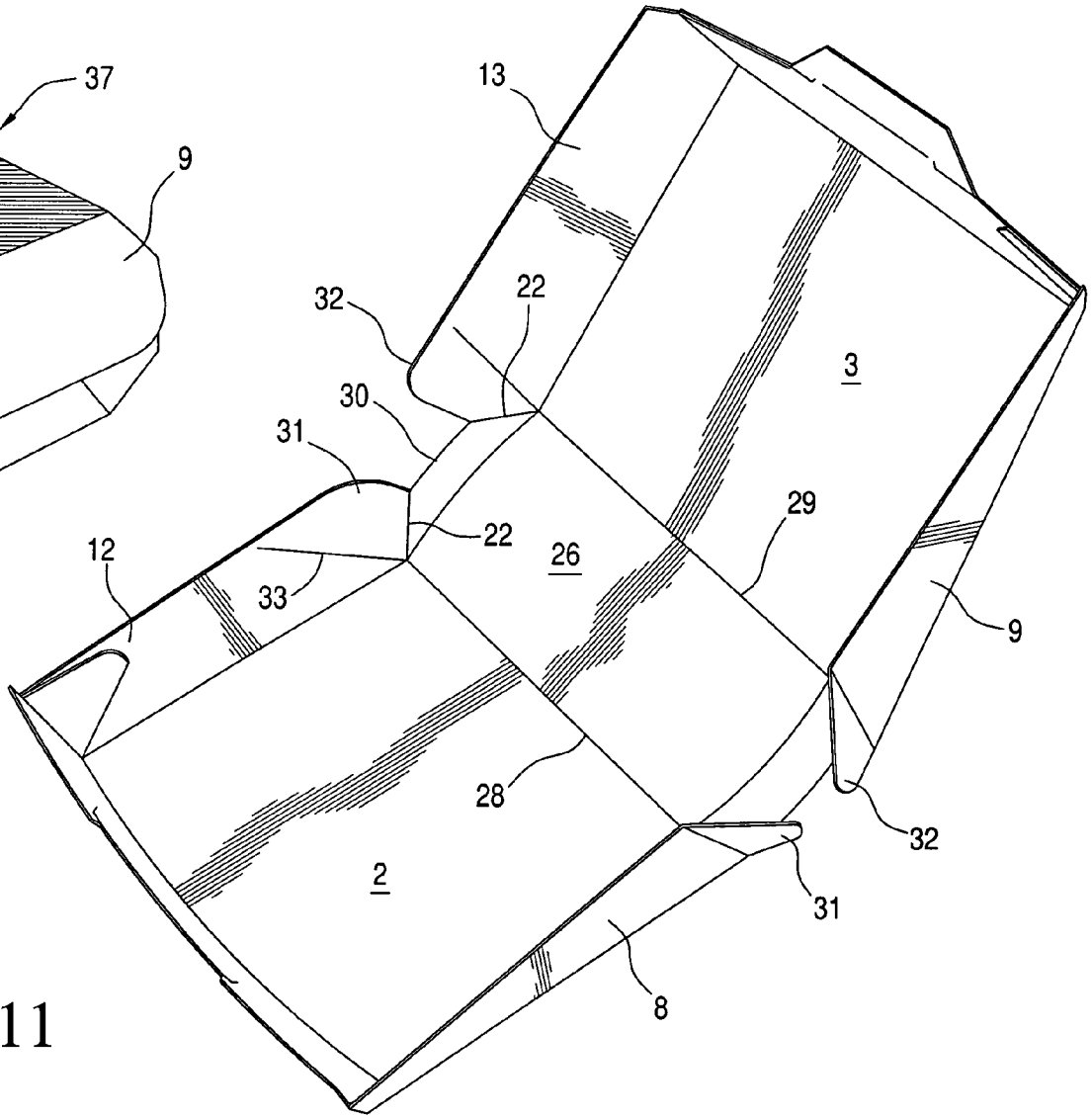
FIG. 11 is a top perspective view of the container of FIG. 10 when it is in the open position.
Figure 10:
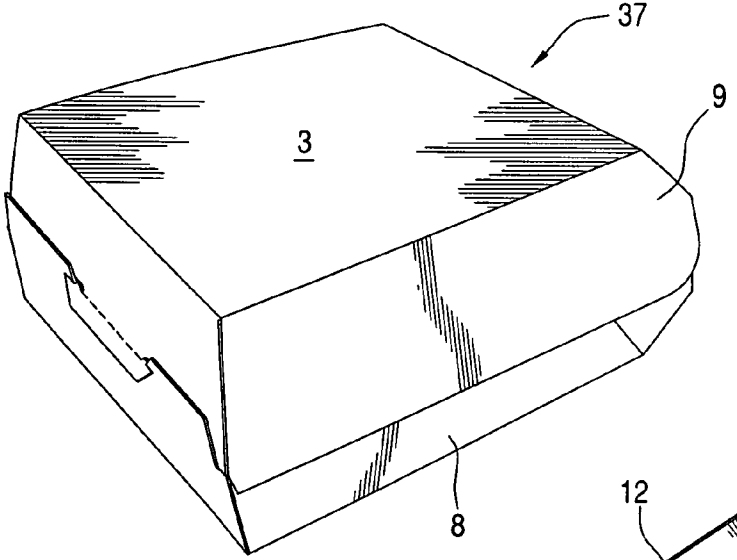
FIG. 10 is a top left front perspective view of a third embodiment of my container.
Figure 12:
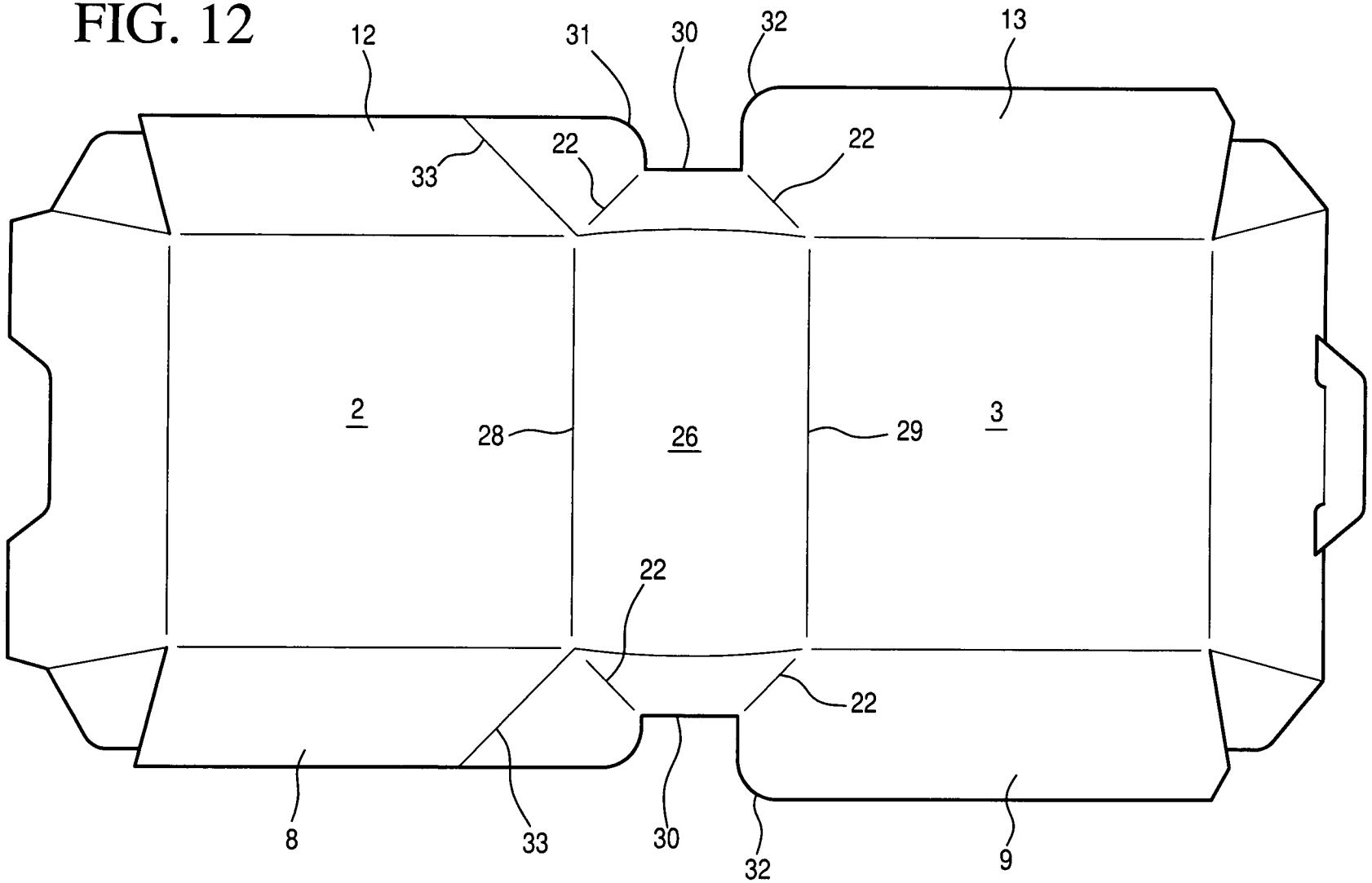
FIG. 12 is a top plan view of the blank used in forming the clam shell container of FIGS. 10 and 11.

Yet another embodiment of my new food service container is shown in FIGS. 10-12 and is shown generally at 37. This container is similar in many regards to the embodiment of FIGS. 4-6.

The most striking visual difference is the absence of the sharp swept-back wings resulting in a smoother curved rear portion.

In this embodiment, it will be seen that the back panel area 26 is delineated by straight score lines 28 and 29 instead of curved score lines. Additionally, instead of the outer sidewalls meeting as a "V", a generally rectangular cut-out 30 is provided medial of the ends of the blank. The top edge of side panel 12 curves down gradually as at 31 meeting with the score line 22. The top edge of sidewall 13 which is higher than sidewall 12 also curves downwardly as at 32 to meet the score line 22.

Diagonal score lines 33 extend from the top of sidewalls 8 and 12 to the point where score lines 28 meet with score lines 22. The score lines 33 are preferably at an angle of 45°. This construction serves to guide or tow-in the sidewalls of the base during the container erection process which enables the sidewalls of the lid or top panel 9 and 13 to extend over or "cap" the outside of the base tray 2 in a controlled or predictable manner as in FIG. 10.

Figures 13, 14:
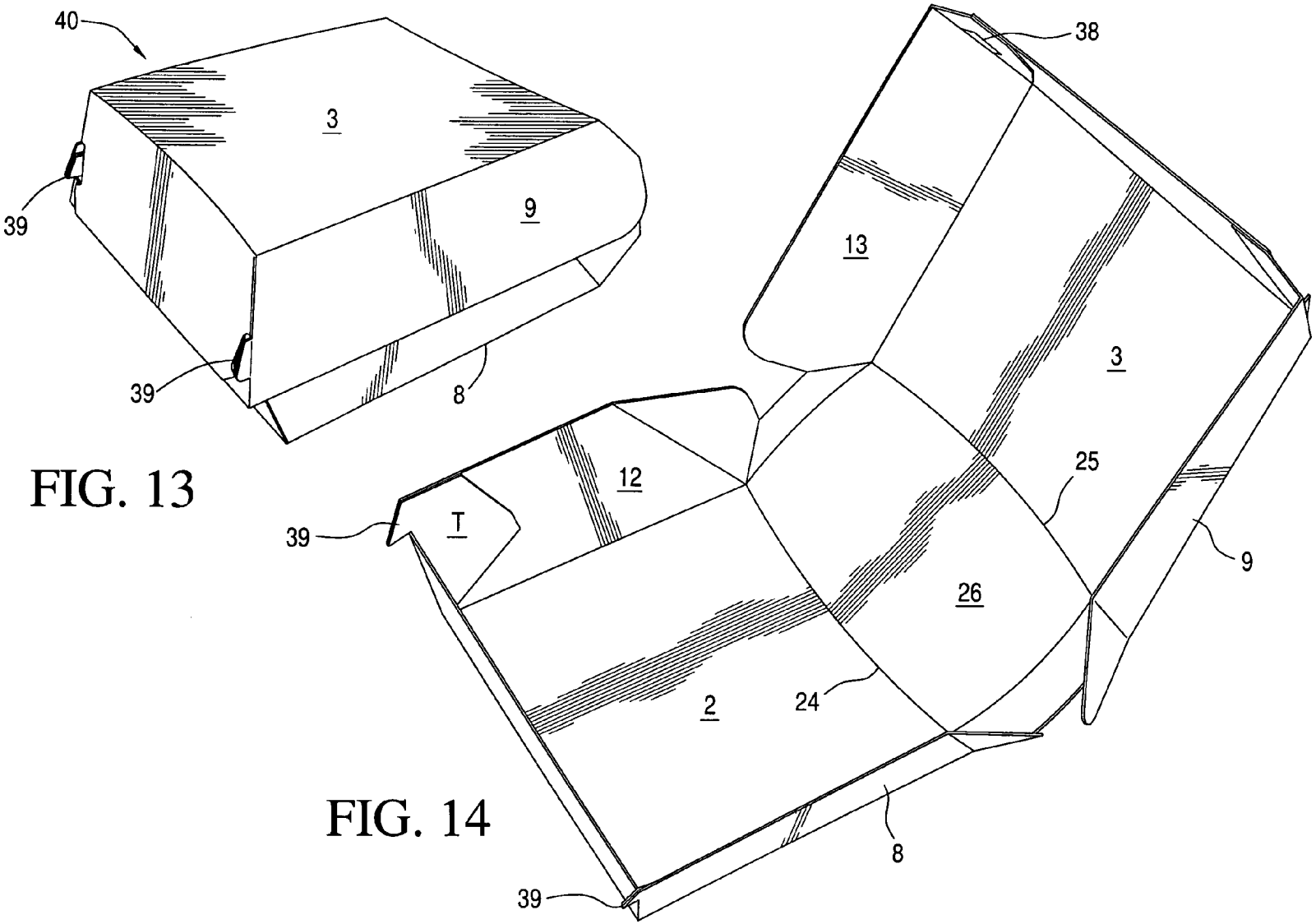
FIG. 13 is a top left front perspective view of a fourth embodiment of my container.
FIG. 14 is a top perspective view of the container of FIG. 13 when it is in the open position.
Figure 15:
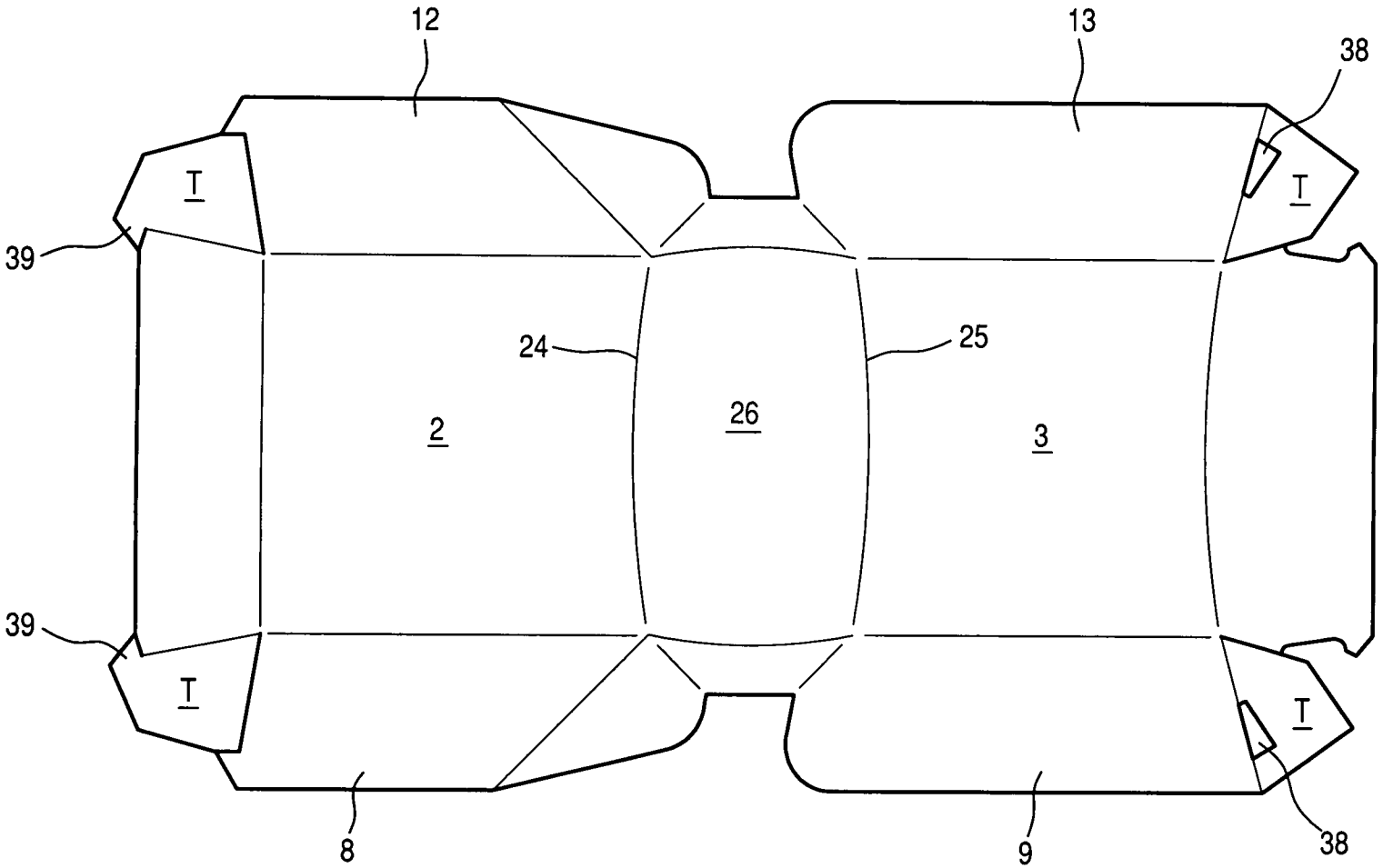
FIG. 15 is a top plan view of the blank used in forming the clam shell container of FIGS. 13 and 14.

A fourth embodiment of my invention 40 as seen in FIGS. 13-15 is similar in many respects to the container 37 of FIG. 10.

In this form of the invention, as in the preferred embodiment of FIG. 1, curved score lines 24 and 25 serve to define the rear wall panel 26. As opposed to the preferred embodiment, the height of the side panels 8, 9, 12, and 13 are the same. The outer edges of each panel extend toward the center of the blank and are parallel to the fold lines 6 and 7 for most of their extent but curve inwardly to meet and form a U-shaped cut-out similar to the FIG. 10 embodiment.

Figures 16, 17:
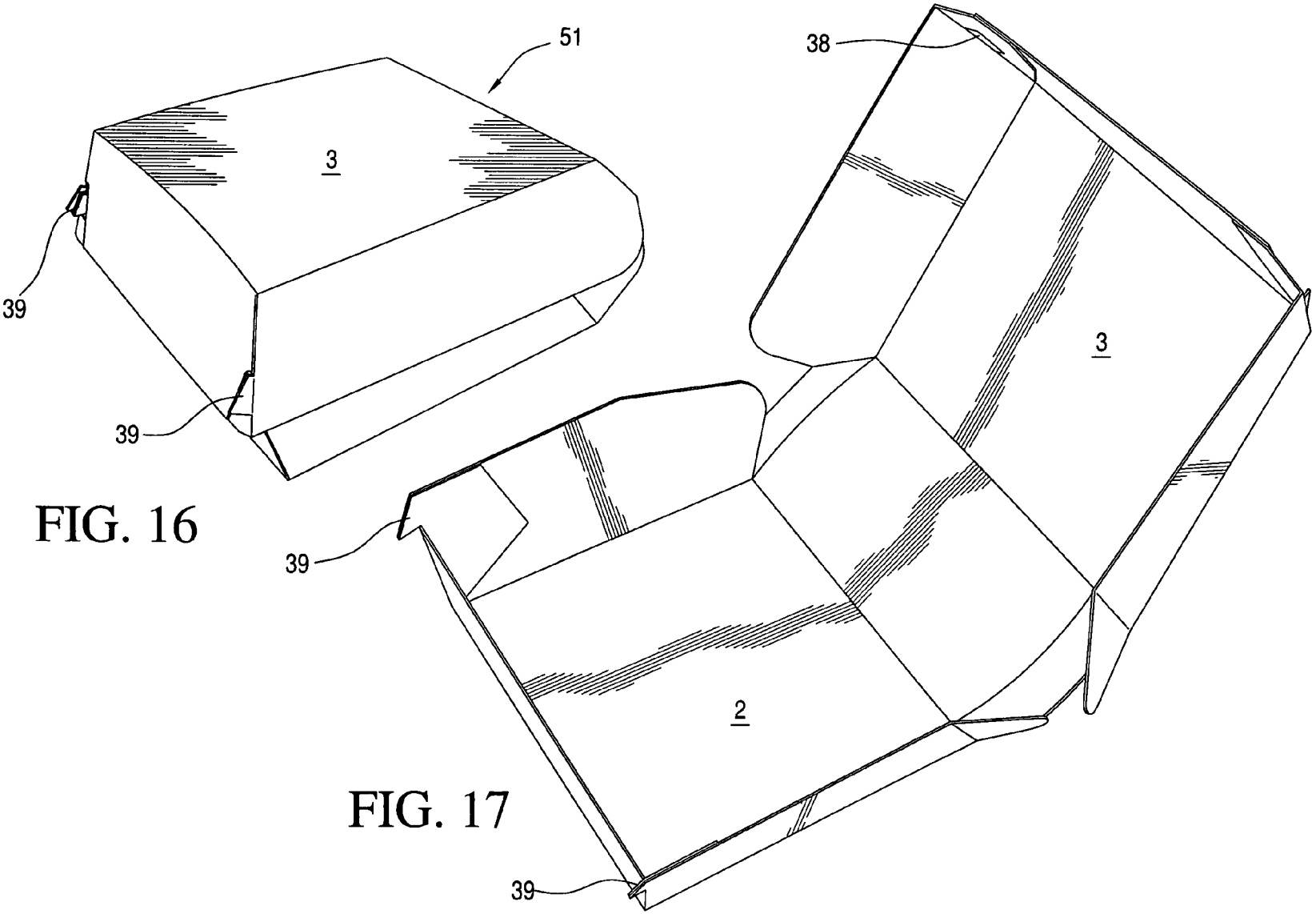
FIG. 16 is a top left front perspective view of a fifth embodiment of my container.
FIG. 17 is a top perspective view of the container of FIG. 16 when it is in the open position.
Figure 18:
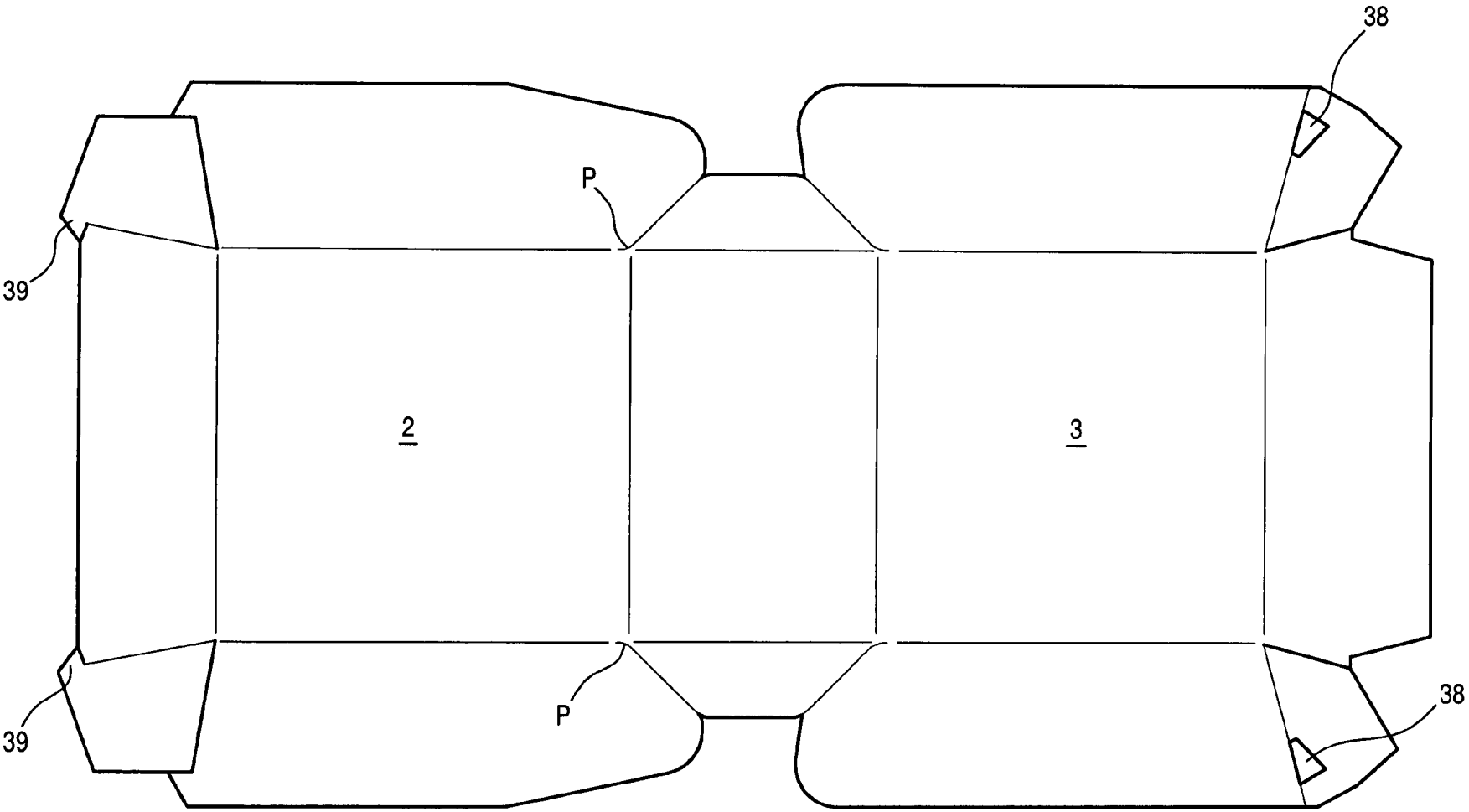
FIG. 18 is a top plan view of the blank used in forming the clam shell container of FIGS. 16 and 17.

A further embodiment of my invention is shown at 51 in FIGS. 16-18. This embodiment is nearly identical to the FIG. 10 embodiment but it utilizes the finger 39 and slot 38 container locking means as in the FIG. 1 embodiment. Note also the radius cuts shown at P adjacent to where the score or fold lines join. This construction assists in the container erection, especially for deep depth cartons as used for double burgers or thick sandwiches.

Figure 19:
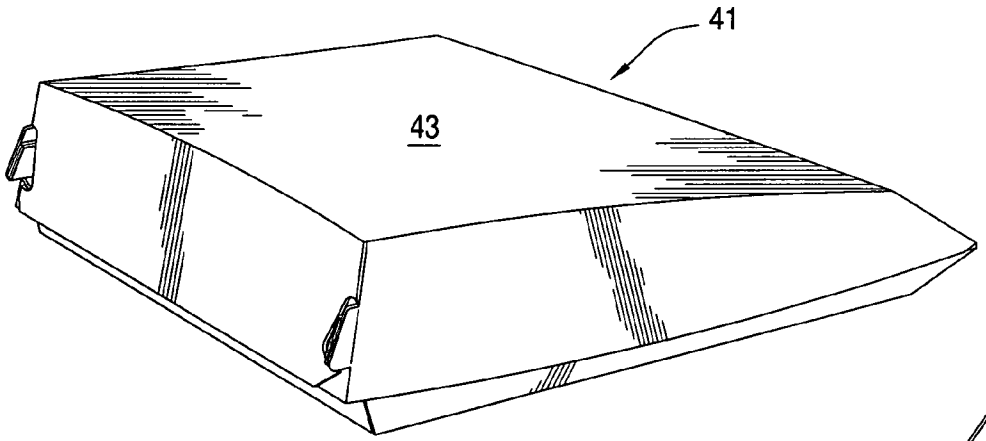
FIG. 19 is a top left front perspective view of a sixth embodiment of my container.
Figure 20:
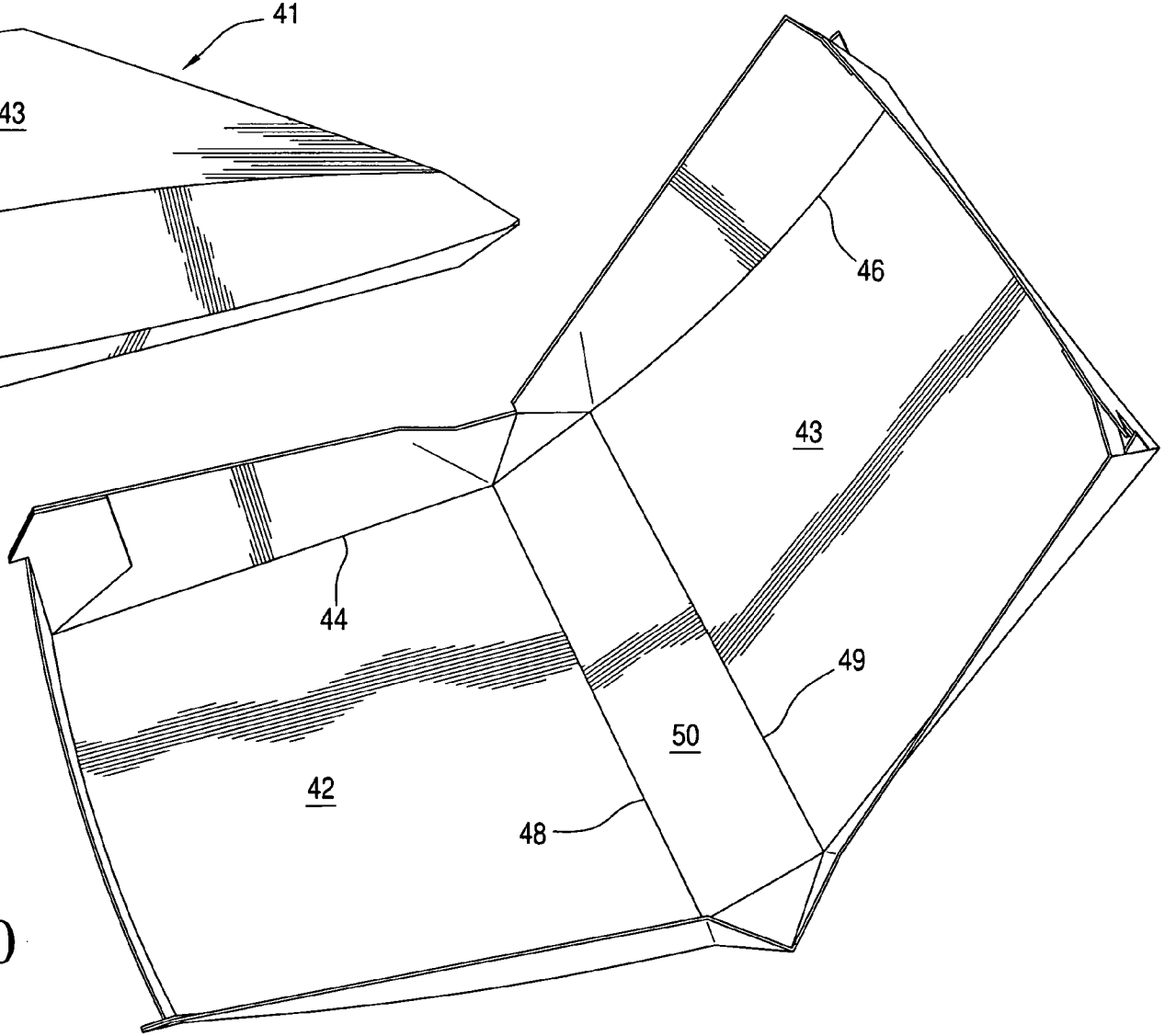
FIG. 20 is a top perspective view of the container of FIG. 19 when it is in the open position.
Figure 21:
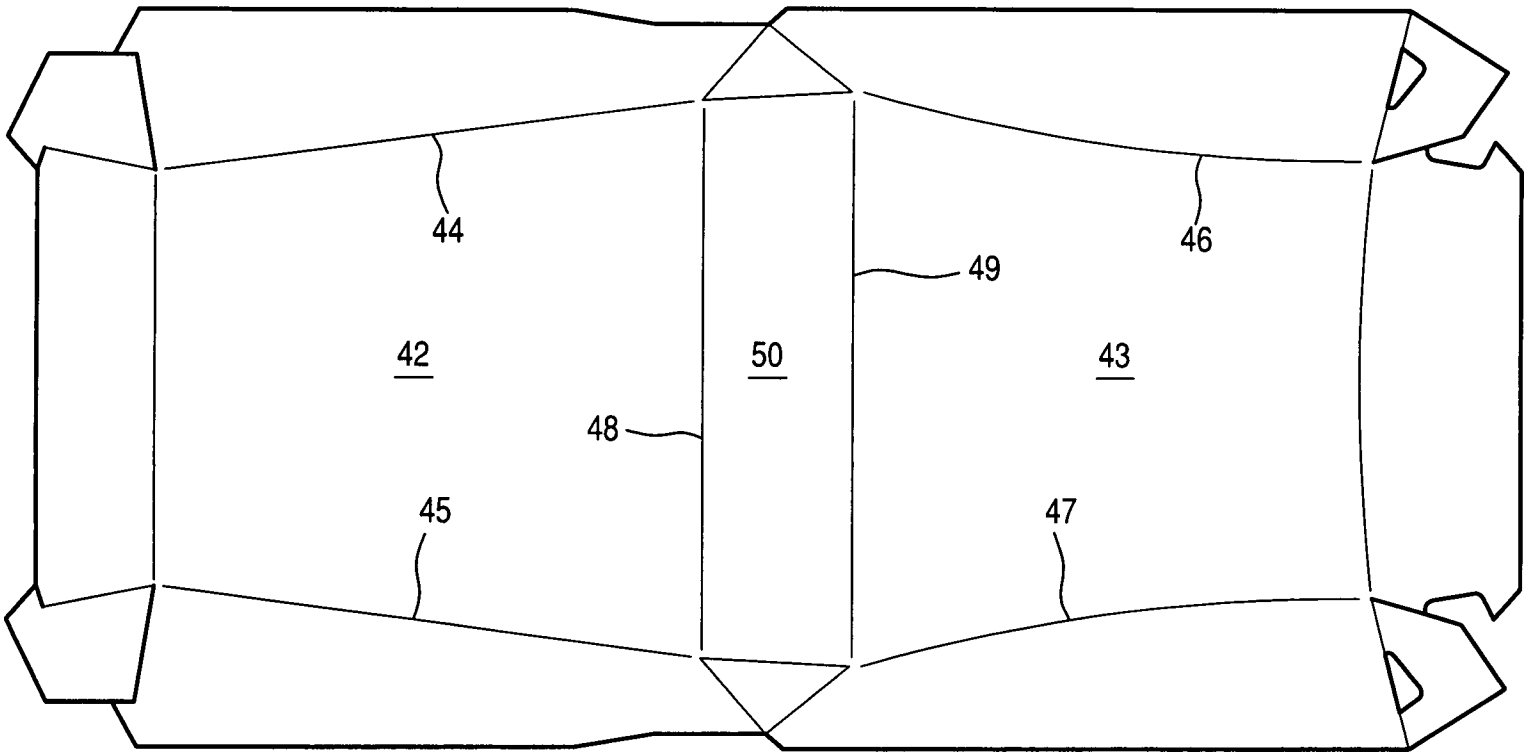
FIG. 21 is a top plan view of the blank used in forming the clam shell container of FIGS. 19 and 20.

The embodiment of FIGS. 19-21 shown as 41 represents an economical container with tapered front and bottom panels 42 and 43. The score lines 44 and 45 formed on panel 42 are straight and converge from the center of the blank to the front.

In contrast, the score lines 46 and 47 formed on the panel 43 are curved inwardly and converge from the center of the blank to the rear as seen in FIG. 21. Straight score lines 48 and 49 serve to define the back panel area 50 as in the FIG. 7 embodiment. The resulting container will have a straight edged back panel with a tapered front lid and contoured front and side panels. The front and bottom panels present a trapezoidal shape.

Figures 22, 23:
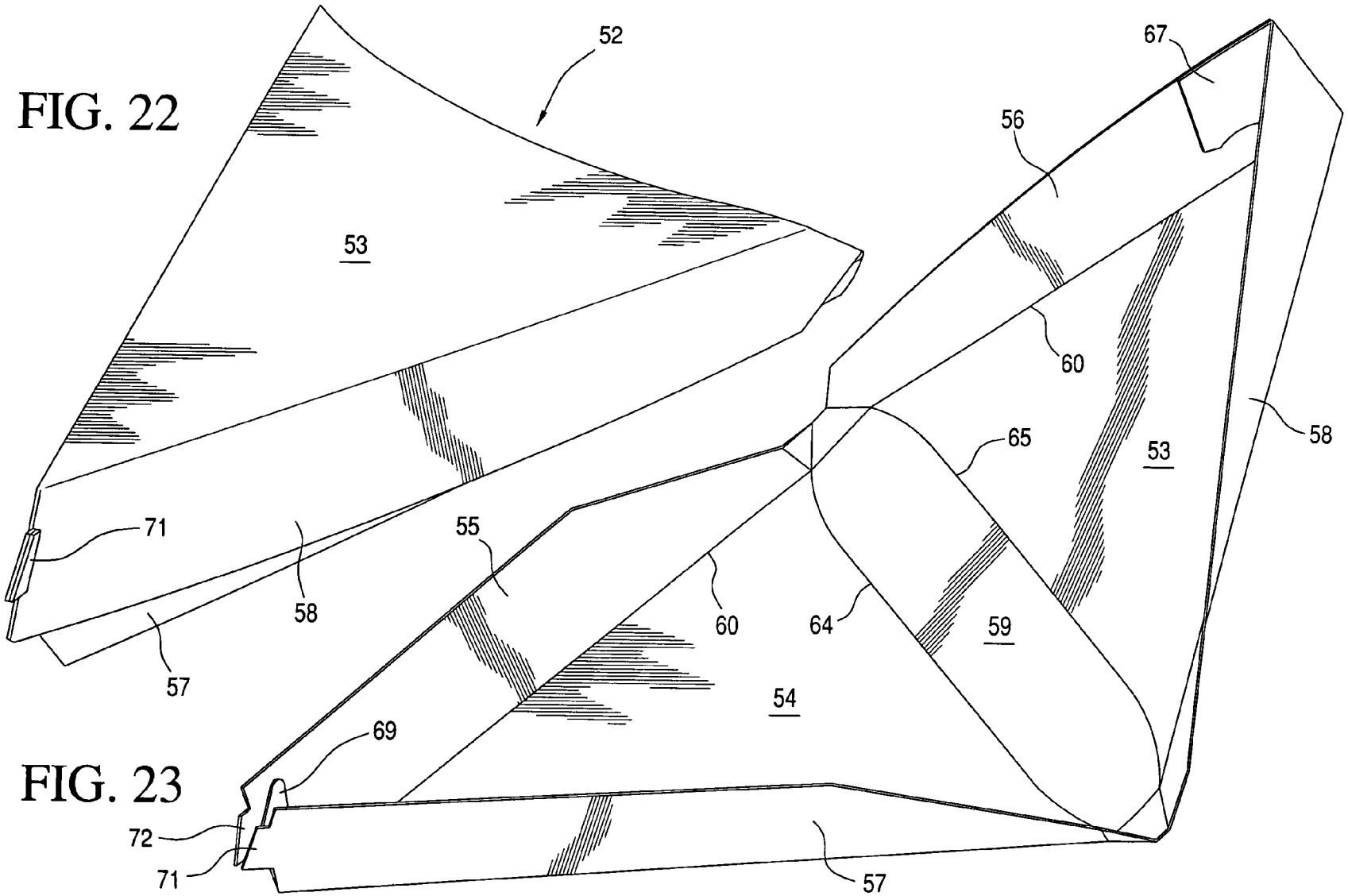
FIG. 22 is a top left front perspective view of a form of my invention specifically adapted for serving pizza or like shaped food products.
FIG. 23 is a top perspective view of the triangular-shaped container of FIG. 12 when it is in the open position.
Figure 24:
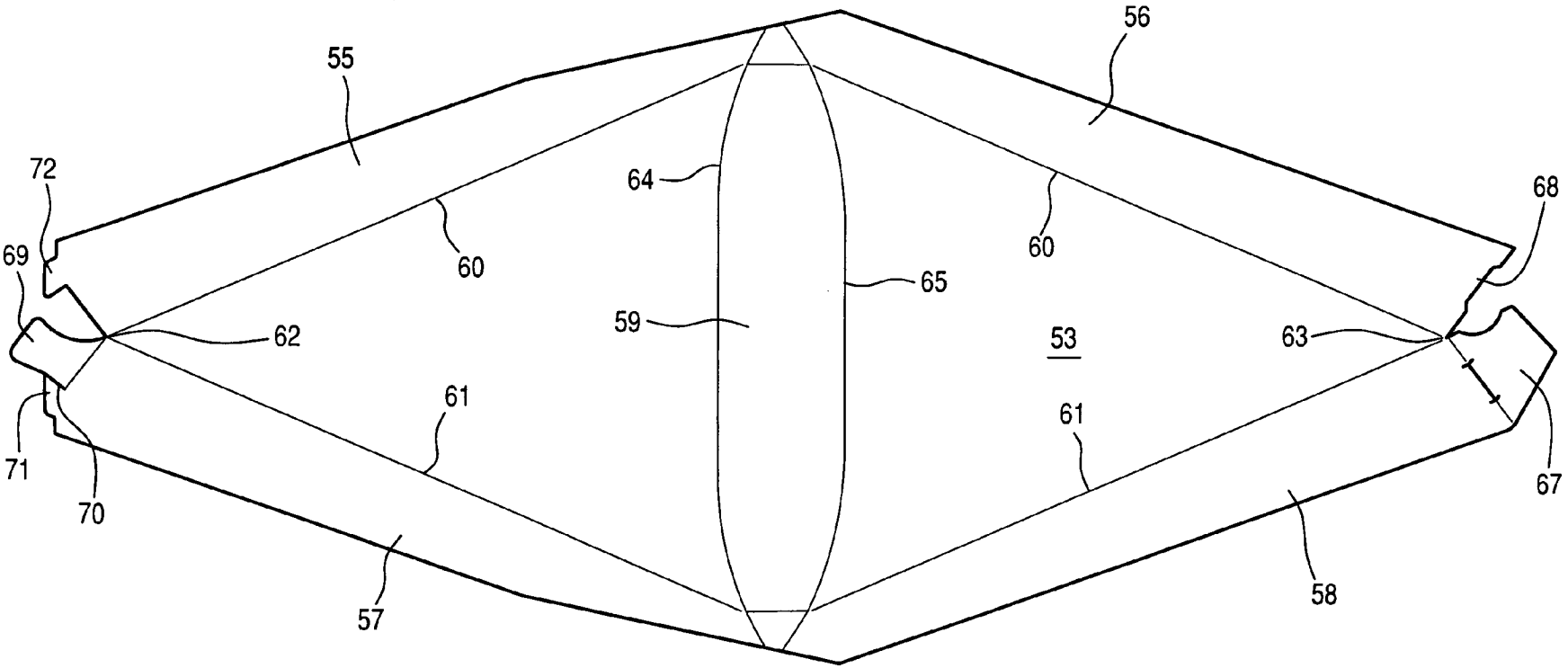
FIG. 24 is a top plan view of the blank used in forming the clam shell container of FIGS. 22 and 23.

A final embodiment employing the improvements previously described and being specifically adapted for serving pizza, slices of pie or other triangular-shaped food products is shown at 52 in FIGS. 22-24.

The blank for forming this embodiment is in the form of a diamond-shaped quadrilateral that is scored to provide a top panel 53 a bottom panel 54 sidewalls 55, 56, 57, and 58 as well as a narrow rear panel 59.

The sidewalls are formed by scored fold lines 60 and 61 spaced inwardly of the outer edges of the blank but angled slightly from the center to the apexes 62 and 63 of the blank. The rear panel is defined by score lines 64 and 65 which are parallel to each other for most of their extent at the central portion of the rear panel and then curve inwardly to meet the fold lines 60 and 61 and then extend to the very edges of the sidewalls 55 and 58. It will be appreciated that the rear panel 59 extremities are within the sidewalls 55 and 57.

The top panel 53 is formed with a glue tab 67 on the end of sidewall 58 which will be adhered to the sidewall 56 as seen in FIG. 23. The end of the sidewall 58 is provided with a small cutout 68 which forms part of the container locking means as described further herein.

The bottom panel includes a glue tab 69 which is adapted to be adhered to the sidewall 55 as shown in FIG. 23. The glue tab 69 is slit as at 70 to define a hook or pawl 71 which is adapted to mate with a similar finger or hook 72 formed on the end of sidewall 55. When the top panel 53 is closed over the bottom panel 54 as seen in FIG. 22, the sidewalls 56 and 58 overlie the sidewalls 55 and 57 respectively and the cutout 68 will snap over the finger or hook 71,72 serving to secure the container in closed position.

I claim:

1. A foldable clam shell food service container formed from a single blank of paperboard material or the like, comprising;

a lid, a base, an intermediate panel joining said lid and said base, the intermediate panel forming a rear wall of the container;

an intermediate fold line between the intermediate panel and each of the lid and the base;

side panels on each of said lid and base defined by side fold lines to define side walls of the erected container;

wherein the container has an open position and a closed position, said intermediate panel forming a flexible hinge construction having end portions disposed between the side panels of the lid and base, respectively, and configured to facilitate closing of the container when the end portions are urged outwardly, the lid, intermediate panel and base form a continuous flat surface when the container is in the open position, and the end portions of the flexible hinge construction have an outward swept wing-like configuration when the container is in the closed position; and further wherein front faces disposed at outer ends of each of said lid and base overlie each other when the container is in the closed position.

2. The container as defined in claim 1, wherein said front faces on said lid and base each have locking means adapted to interengage with each other to lock the container in the closed position.

3. The container as defined in claim 2, wherein said locking means includes hook means on the front face of the lid and recess means on the front face of the base to receive said hook means.

4. The container as defined in claim 1, wherein said side panels extend laterally from each side of each of said lid and base, said side panels on said lid adapted to overlap said side panels on said base when the container is in the closed position to define the side walls of the container.

5. The container as defined in claim 1, wherein the fold lines between the intermediate panel and each of the lid and the base have an arcuate portion.

6. The container as defined in claim 5, wherein said side panels taper outwardly from a point where the side panels on the lid and base join each other, the arcuate portion of said fold lines meeting where the side panels join each other.

7. The container as defined in claim 1, wherein the side panels on said lid are wider than the side panels on said base.

8. The container as defined in claim 1, wherein the base of the container is trapezoidal in shape.

9. The container as defined in claim 1, wherein the shape of the container in the closed position tapers from the front to the rear.

10. The container as defined in claim 4 and further including score lines on the side panels of said base extending at an angle of substantially 45 degrees from the fold lines defining the side panels to an edge of said side walls of the base.

11. The container of claim 1, further comprising score lines disposed between the end portions and the side panels.

12. The container of claim 1, wherein the end portions have a triangular shape.

13. The container of claim 1, wherein the end portions have a trapezoidal shape.

14. A triangular shaped foldable clam shell food service container formed from a single blank of paperboard material or the like for serving pizza and similar shaped food products, comprising;

a lid and a base, each having a triangular shape, an intermediate panel joining said lid and said base, the intermediate panel forming the rear wall of the container;

an intermediate fold line between the intermediate panel and each of the lid and the base;

side panels on each of said lid and base defined by side fold lines to serve as side walls of the erected triangular container;

wherein the container has an open position and a closed position, said intermediate panel forming a flexible hinge construction having end portions disposed between the side panels of the lid and base, respectively, and configured to facilitate closing of the container when the end portions are urged outwardly, the lid, intermediate panel and base form a continuous flat surface when the container is in the open position, the end portions of the flexible hinge construction have an outward swept wing-like configuration when the container is in the closed position, and further wherein said side panels on each of said lid and base are adapted to overlie each other when the container is in the closed position.

15. The triangular shaped foldable clam shell food service container as defined in claim 14, wherein said side panels on each side of said lid and base join together at an apex and wherein a locking means is provided on each apex to lock the container in the closed position.

16. The triangular shaped foldable clam shell food service container as defined in claim 14 wherein the fold lines between the intermediate panel and each of the lid and the base have an arcuate portion.

17. A blank for forming a flexible clam shell food service container, said blank being preformed from a flat sheet of paperboard, said blank being scored laterally adjacent its center by a pair of opposed spaced apart fold lines having a portion adjacent the ends of the fold lines being arcuate in shape to define an intermediate panel, a portion of the blank located above one of the fold lines defining a lid of the container, a portion of the blank located below the other fold line defining a base of the container, a pair of generally longitudinal score lines on the sides of each of said lid and base of said blank spaced inwardly of the sides thereof to define foldable side panels of the container, wherein the container when formed from the blank has an open position and a closed position, said intermediate panel forming a flexible hinge construction having end portions disposed between the side panels of the lid and base, respectively, and configured to facilitate closing of the container when the end portions are urged outwardly, the lid, intermediate panel and base form a continuous flat surface when the container is in the open position, and the end portions of the flexible hinge construction have an outward swept wing-like configuration when the container is in the closed position.

18. The blank as defined in claim 17, wherein the width of the foldable side panels increases outwardly from the center of the blank.

19. The blank as defined in claim 17 and further including flap portions extending outwardly from each of said lid and base portions of said blank.

20. The blank as defined in claim 19 and further including a locking hook formed adjacent an end of said flap portion extending from said base portion of the blank and slit means formed on the flap portion extending from the lid portion of the blank.

21. A blank for forming a flexible clam shell food service container, said blank being preformed from a flat sheet of paperboard, said blank being scored laterally adjacent its center by a pair of opposed and parallel spaced apart fold lines to define an intermediate panel, a portion of the blank located above one of the fold lines defining a lid of the container, a portion of the blank located below the other fold line defining a base of the container, a pair of generally longitudinal score lines on the sides of each of said lid and base of said blank spaced inwardly of the sides thereof to define foldable side panels of the container, said longitudinal score lines joining with the parallel fold lines by small radius cuts which serve to aid in the erection of the said container, wherein the container when formed from the blank has an open position and a closed position, said intermediate panel forming a flexible hinge construction having end portions disposed between the side panels of the lid and base, respectively, and configured to facilitate closing of the container when the end portions are urged outwardly, the lid, intermediate panel and base form a continuous flat surface when the container is in the open position, and the end portions of the flexible hinge construction have an outward swept wing-like configuration when the container is in the closed position.

* * * * *